United States Patent [19]

Fluck

[11] Patent Number: 4,669,600

[45] Date of Patent: Jun. 2, 1987

[54] APPARATUS FOR FORMING GROUPS OF EDGEWISE UPRIGHT ORIENTED ARTICLES AND METHOD OF OPERATING THE APPARATUS

[75] Inventor: René Fluck, Schleitheim, Switzerland

[73] Assignee: SIG Schweizerische Industrie-Gesellschaft, Neuhausen am Rheinfall, Switzerland

[21] Appl. No.: 759,164

[22] Filed: Jul. 26, 1985

[30] Foreign Application Priority Data

Jul. 31, 1984 [CH] Switzerland ..... 3705/84

[51] Int. Cl.[4] ..... B65G 29/00

[52] U.S. Cl. ..... 198/408; 198/412; 198/416; 198/425; 414/107

[58] Field of Search ..... 198/408, 409, 412, 415, 198/416, 424–426, 429, 430; 414/48, 49, 80, 104, 108, 107; 53/532, 542

[56] References Cited

U.S. PATENT DOCUMENTS

| | | | |
|---|---|---|---|
| 3,930,572 | 1/1976 | Fluck et al. | 198/425 X |
| 4,082,176 | 4/1978 | Pommer | 198/425 X |
| 4,098,392 | 7/1978 | Greene | 198/425 |
| 4,244,460 | 1/1981 | Groundwater | 198/429 |
| 4,296,590 | 10/1981 | Focke | 198/425 X |
| 4,364,467 | 12/1982 | Blakelock | 198/429 |
| 4,394,899 | 7/1983 | Fluck | 198/425 X |
| 4,462,515 | 7/1984 | Fischer | 198/426 |
| 4,522,294 | 6/1985 | Walz | 198/429 |
| 4,552,261 | 11/1985 | Raudat et al. | 198/425 |
| 4,611,705 | 9/1986 | Fluck | 198/425 |

FOREIGN PATENT DOCUMENTS 2116508 9/1983 United Kingdom .

*Primary Examiner*—Robert J. Spar
*Assistant Examiner*—Lyle Kimms
*Attorney, Agent, or Firm*—Spencer & Frank

[57] ABSTRACT

An apparatus for forming article groups each consisting of a plurality of edgewise upright oriented, generally flat stacked articles, includes a first conveyor for individually advancing the articles in a lying orientation; a second conveyor for receiving the articles from the first conveyor and for depositing the articles individually on a gathering channel in an edgewise upright orientation; a first article group shifting unit for periodically forming one group of articles of predetermined number from articles accumulating on the gathering channel as deposited by the second conveyor and for individually advancing that group on the gathering channel away from the second conveyor; a second article group shifting unit forming a second group of articles of predetermined number from articles accumulating on the gathering channel as deposited by the second conveyor, and simultaneously advancing the first and second groups on the gathering channel to a discharge end thereof.

6 Claims, 6 Drawing Figures

APPARATUS FOR FORMING GROUPS OF EDGEWISE UPRIGHT ORIENTED ARTICLES AND METHOD OF OPERATING THE APPARATUS

BACKGROUND OF THE INVENTION

This invention relates to an apparatus associated with a packing machine and being of the type which forms groups of edgewise upright oriented flat articles such as confectionary items. The articles are, in a lying state, individually advanced by a first conveyor to a wheel-like second conveyor which has a plurality of transfer pushers. After the second conveyor has moved at least approximately one-quarter of a revolution, the respective transfer pushers shift the articles onto a gathering channel in an edgewise upright orientation. The transfer pushers are pivotally jointed to the second conveyor to execute a limited pivotal motion. Upon reaching the transfer point at the gathering channel, the transfer pushers are swung into an inoperative position.

The grouping of flat articles such as confectionary items has involved difficulties for a considerable time because the articles have to be handled in a gentle manner to avoid damages and further, the groups must contain an accurately counted number of articles or must have an unchanging weight per group. Also, a high-speed output is a primary desideratum in such machines.

British Pat. No. 2,116,508 discloses an apparatus for forming a plurality of side-by-side arranged article groups. The articles, such as confectionary items (biscuits) are, as they emerge from the baking oven, aligned in twelve rows and are edgewise upright oriented in a gravity chute and thereafter advanced by pushers in two groups to a conveyor chain, whereby groups of six articles each are formed. The groups may then be advanced to subsequent conveyor arrangements provided with article carriers to continue conveyance of the groups in a serial arrangement. Such a system may be built for a desired number of articles per group as determined at the output of the baking oven. The number of articles in the groups, however, cannot be subsequently changed. The conveyance is effected stepwise with positive and negative acceleration phases which involves a high risk of damaging the delicate articles. The rows of articles emerging from the baking oven must be accurately counted and in the event of a missing article, a complementation of the group is not feasible.

U.S. Pat. No. 4,394,899 describes another type of apparatus for counting articles for the purpose of forming groups therefrom. The formation of groups is effected by a conveyor wheel which has a number of radially extending and restrictively pivotal transfer pushers. The articles which are delivered to the conveyor wheel in a lying orientation, are, by virtue of the rotation of the conveyor wheel, individually turned by 90° for orienting them into an edgewise upright position. In an inlet zone the articles are pushed onto a gathering rail where they are handled in groups by a gathering pusher and advanced thereby to a subsequent conveyor arrangement. This apparatus operates with uniform conveying speeds in each phase. The articles are exposed to negligible friction and practically no pressure is applied thereto. The group length may be varied in a simple manner. It is, however, a disadvantage of this known apparatus that in each cycle only a single group may be formed. This characteristic significantly limits the output of the packing machine with which the article grouping apparatus is associated.

SUMMARY OF THE INVENTION

It is an object of the invention to provide an improved apparatus particularly of the type disclosed in U.S. Pat. No. 4,394,899 with which simultaneously a plurality of groups may be advanced whereby the output of the apparatus is significantly increased.

This object and others to become apparent as the specification progresses, are accomplished by the invention, according to which, briefly stated, the apparatus comprises a first group shifting unit for advancing one group of counted articles on the gathering channel and a second group shifting unit for the simultaneous conveyance of at least two groups on the gathering channel, to a transfer location for transferring them to a further conveying device.

DESCRIPTION OF THE PREFERRED EMBODIMENT

Figure 1:
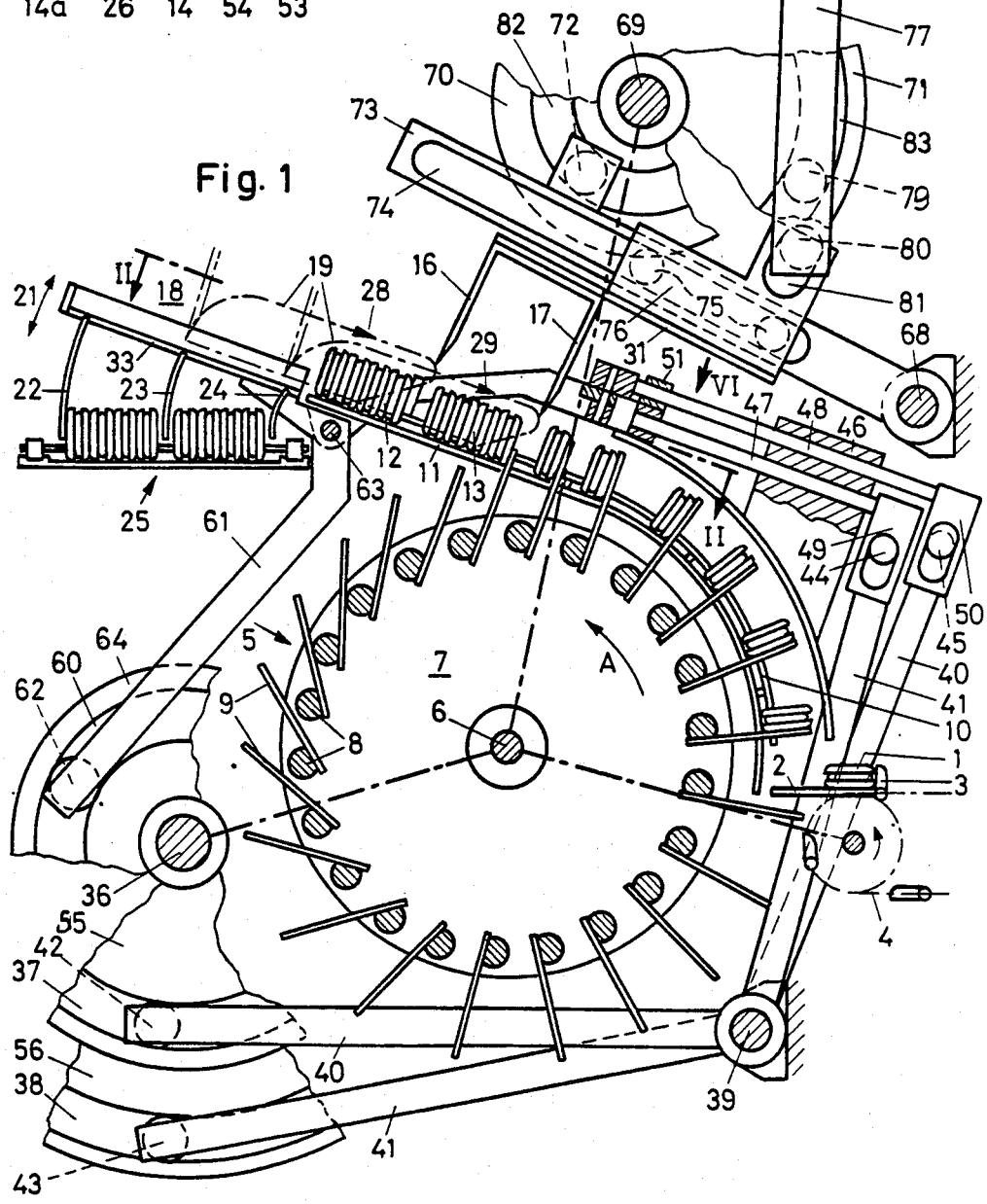
FIG. 1 is a sectional side elevational view of a preferred embodiment of the invention taken along line I—I of FIG. 2.
Figure 2:
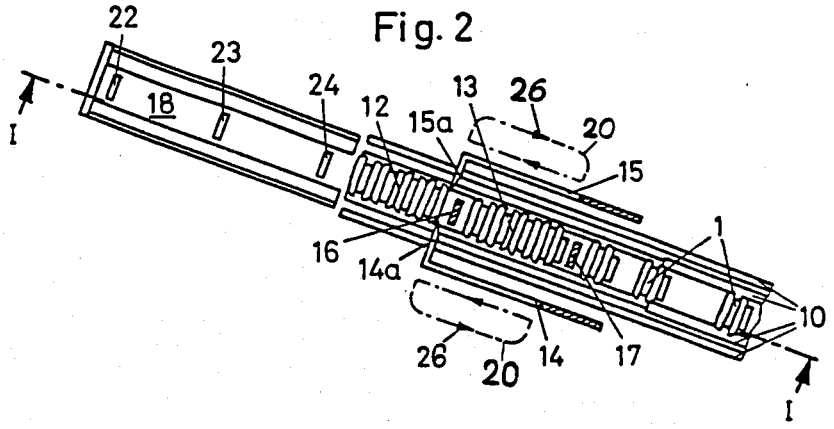
FIG. 2 is a sectional view taken along line II—II of FIG. 1.

Turning to FIGS. 1 and 2, the apparatus shown therein is operatively connected to the output of a confectionary machine (not shown) which makes sandwich-like articles 1, each formed of two baked wafers with, for example, chocolate cream therebetween. It is readily apparent that such confectionary items have a variable thickness and are extremely sensitive to shocks and jars. The articles 1 are advanced on a conveyor 4 equidistantly in a lying orientation to a slide table 2. The conveyor 4 may be a conveyor chain or a belt which carries article pushers 3. There may be provided a plurality of side-by-side arranged conveyors 4. The discharge end of the slide table 2 is adjoined by a conveyor wheel 5 which, as indicated by arrow A, is rotated counterclockwise by a drive shaft 6. The conveyor wheel 5 has two face-to-face arranged, axially spaced discs 7 between which a plurality of circumferentially distributed shafts 8 are mounted which are pivotal to a limited extent. Each shaft 8 carries one or more transfer pushers 9, whose number corresponds to that of the side-by-side arranged conveyors 4. As the conveyor wheel 5 rotates, the transfer pushers 9 assume an interleaving relationship with the slide table 2 and lift off the articles 1 therefrom. The articles 1 are laterally guided during their circular travel with the conveyor wheel 5 by guide bars 10 which, in the inlet zone, curve coaxially to the axis of the shaft 6 and in the outlet zone they extend tangentially away from the conveyor wheel 5 to form a gathering channel 11. As a result of this arrangement, the transfer pushers 9 move downwardly out of the conveying track formed by the guide bars 10 in the inlet region of the gathering channel 11.

Figure 6:
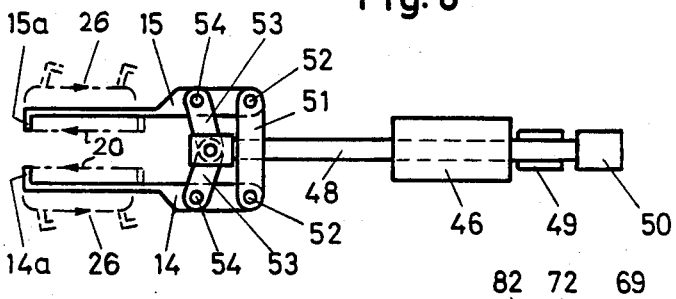
FIG. 6 is a top plan view of a component of the preferred embodiment, viewed in the direction of arrow VI of FIG. 1.

Also referring now to FIG. 6, in the zone of the guide bars 10 where the transfer pushers 9 move away therefrom, there is arranged a first group shifting unit which comprises two forks 14 and 15 arranged laterally of the gathering channel 11 and equipped with respective shifting elements 14*a*, 15*a* projecting into the travelling path of the articles 1. The forks 14 and 15 are articulated to a first guide rod 48 by toggle links 53 which are jointed to the respective forks 14 and 15 by pins 54. Further, the forks 14 and 15 are fixedly connected with a second guide rod 47 by means of pins 52 and a guide head 51. The two parallel arranged guide rods 47 and 48 are guided in a guide block 46 and their other end is inserted in a fork head 49 and 50, respectively. Each of the fork heads 49 and 50 is, by means of a shaft 44 and 45, longitudinally displaceably connected with respective angled levers 40, 41. The two angled levers 40 and 41 which are rotatably supported by a common stationary pivot 39 carry, at their free ends, respective follower rollers 42, 43 which are received in respective cam tracks 37 and 38 of respective cam discs 55, 56. By means of this driving arrangement, the shifting elements 14*a*, 15*a* describe a travelling path illustrated in dash-dotted lines 20 in FIGS. 2 and 6. Thus, the shifting elements 14*a*, 15*a* are moved towards one another (and into the travelling path of the articles 1) for the forward (working) strokes of the forks 14 and 15 and the shifting elements 14*a*, 15*a* are moved away from one another (and out of the travelling path of the articles 1) for the return (idling) strokes of the forks 14 and 15.

Figure 3:
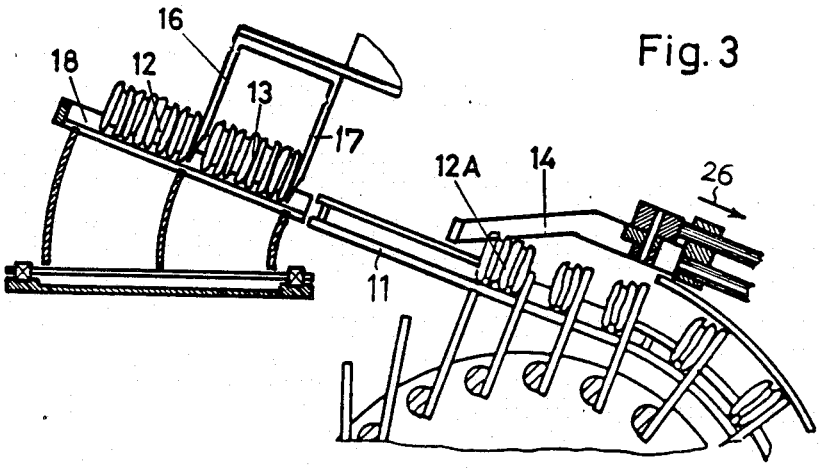
FIGS. 3, 4 and 5 are fragmentary sectional side elevational views of the same components of the preferred embodiment illustrating three different operational phases thereof.
Figure 4:
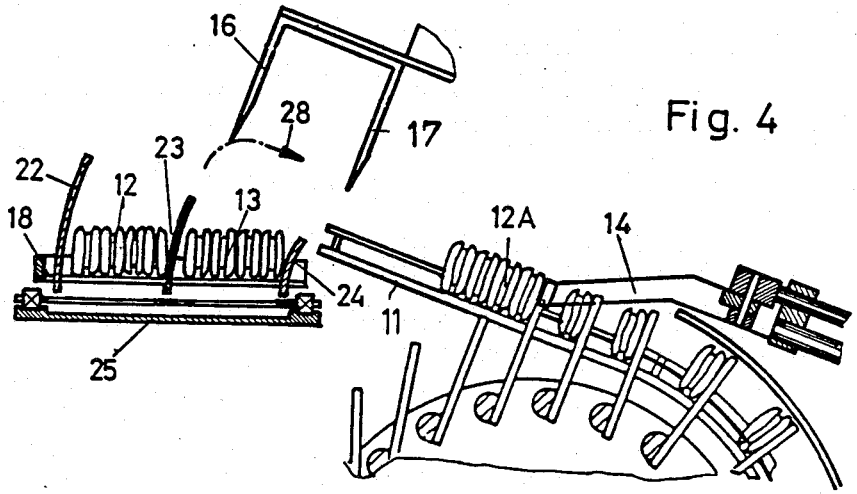

A second group shifting unit including separating fingers 16 and 17 is guided above the gathering channel 11 in a carrier lever 73 which is pivotally supported by a stationary pin 68 and which has a longitudinal guide track 74 for a pair of follower rollers 75 supported in a guide housing 76. The separating fingers 16 and 17 are affixed to the guide housing 76 to form a one-piece component therewith. A first cam disc 70 having a cam track 82 serves for guiding a follower roller 72 whose shaft (not shown) is rigidly connected with the carrier lever 73. This guide arrangement causes a pivotal motion of the carrier lever 73 in a vertical plane. A second cam disc 71 comprising a cam track 83 is provided for guiding therein a follower roller 79 whose shaft (not shown) is rigidly connected with a pivotal lever 77 swingably supported by a pin 78. The pivotal lever 77 has a follower roller 80 which projects into a cam track 81 which is provided on the carrier lever 73 and which is perpendicular to the longitudinal guide track 74. This drive arrangement causes the guide housing 76 to be displaced along the carrier lever 73. Thus, the two cam tracks 82 and 83 together cause the separating fingers 16 and 17 to execute displacements 18 according to arrows 28 and 29 (FIGS. 1, 3 and 4). Thus, the fingers 16, 17 are moved towards the gathering channel 11 (and into the travelling path of the articles 1) for the forward (working) strokes parallel to the gathering channel 11, and the fingers 16, 17 are moved away from the gathering channel 11 (and out of the travelling path of the articles 1) for the return (idling) strokes of the fingers 16, 17. The cam discs 70 and 71 are rigidly affixed to a common shaft 69 which, in turn, is driven together with the shafts 6 and 36.

At the transfer location 18 a pivotally supported table 33 is provided which is traversed by three guide rails 22, 23 and 24 and is affixed to an angled lever 61 to form a rigid unit therewith. The angled lever 61 is pivotally supported by a stationary pin 63 and carries a follower roller 62 which projects into a cam track 60 of a cam disc 64, whereby the table 33 is pivoted in a vertical plane in order to deposit the article groups 12 and 13 situated thereon, onto a further conveyor device 25. The cam disc 64 is, similarly to the cam discs 55 and 56, affixed to the shaft 36.

By means of a particular selection of the operating speeds, particularly for achieving a penetration and shifting of the just previously formed groups 12, 13 on the gathering channel 11 in synchronism with the movement of the conveyor wheel 5, a gentle handling of the articles during group formation is ensured. If the linear movement of the separating finger pair 16, 17 in the direction towards the transfer station 18 is effected with a higher speed than that of the upstream-arranged shifting forks 14, 15, a clearance is formed between the two group shifting units permitting a return motion of the second group shifting unit 16, 17. During this occurrence, however, care has to be taken that the lowering of the separator fingers 16 and 17 towards the gathering channel 11 also occurs synchronously with the motion of the first group shifting unit 14, 15 and is thus effected synchronously with the motion of the conveyor wheel 5. Such a synchronism is achieved by commonly driving the shafts 6, 36 and 69.

In the phase depicted in FIG. 3, two groups 12 and 13 have been displaced to the transfer station 18 by the separating finger pair 16, 17 of the second group shifting unit. Since this has been effected by a greater speed than that of the conveyance with the conveyor wheel 5, the gathering rail 11 is practically empty because up to that point only two articles of a further group 12A have been placed thereonto. The forks 14 and 15 of the first group shifting unit are moved backward along the track 20 in the direction of the arrow 26 (FIGS. 3 and 6). The table 33 is subsequently lowered as illustrated in FIG. 4 and the rails 22, 23 and 24 assume the function of the separating fingers 16 and 17 to maintain the two groups 12 and 13 separated from one another during their transfer onto the third conveyor assembly 25. During this period, the new article group 12A has been formed and may then be pushed forwardly on the gathering rail 11 with the shifting forks 14 and 15. Simultaneously, the separating fingers 16 and 17 are moved back along path 28.

Figure 5:
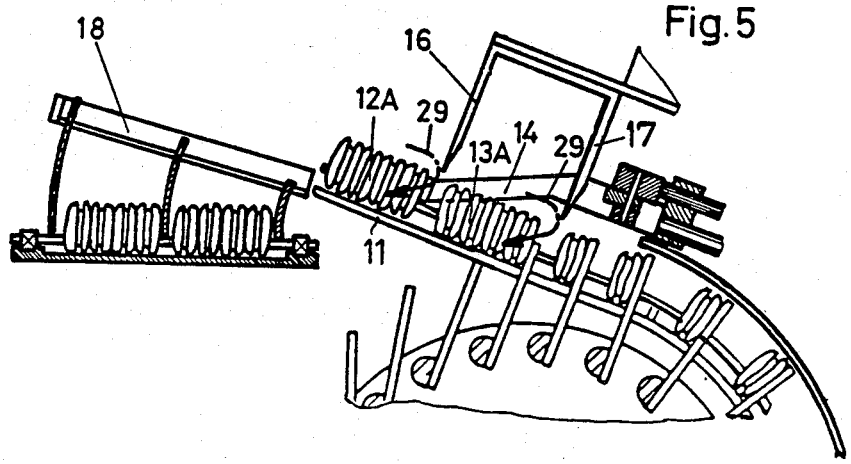

While, according to FIG. 5, a new second group 13A is being formed, the previously formed new first group 12A attains its foremost position prior to being shifted onto the transfer station 18. The separating fingers 16 and 17 now move along the path portion 29 behind the second group 13A and between the two groups 12A and 13A.

During the rearward motion of the separating fingers 16 and 17 sufficient time was available for the table 33 to return to the transfer station 18, whereupon a new cycle starts until the position according to FIG. 3 is reached.

It will be understood that the above description of the present invention is susceptible to various modifications, changes and adaptations, and the same are intended to be comprehended within the meaning and range of equivalents of the appended claims.

What is claimed is:

1. In an apparatus for forming article groups each consisting of a plurality of edgewise upright oriented, generally flat stacked articles, including a first conveyor means for individually advancing the articles in a lying orientation; a second conveyor means for receiving the articles from said first conveyor means for depositing the articles individually on a gathering channel in an edgewise upright orientation; the improvement comprising (a) a first article group shifting means for periodically forming a first group of articles of predetermined number from articles accumulating on said gathering channel as deposited by said second conveyor means and for individually advancing said first group on said gathering channel, along a first shifting path, away from said second conveyor means; and (b) a second article group shifting means for periodically forming a second group of articles of predetermined number from articles accumulating on said gathering channel as deposited by said second conveyor means and for simultaneously advancing on said gathering channel to a discharge end thereof, along a second shifting path, said second group formed by said second article group shifting means and said first group formed by said first article group shifting means; said second shifting path being codirectional with said first shifting path and having a length portion being situated downstream of said first shifting path as viewed in a direction of article advance on said gathering channel.

2. An apparatus as defined in claim 1, wherein said first article group shifting means comprises (a) two article shifting forks situated on opposite sides of said gathering channel laterally thereof;

(b) first means for periodically moving said forks towards and away from one another to project into and, respectively, to be clear of a travelling path of the articles on said gathering channel;

(c) second means for moving said forks as a unit back and forth parallel to said direction of article advance to execute alternating forward strokes and return strokes; and (d) synchronizing means for coordinating said first and second means with one another for moving said forks towards one another at the beginning of each forward stroke and for moving said forks away from one another at the beginning of each return stroke.

3. An apparatus as defined in claim 1, further comprising synchronizing means for coordinating motions of said first and second article group shifting means for sequentially moving said second article group shifting means with said first and second groups and said first article group shifting means with a new first group of articles.

4. An apparatus as defined in claim 1, further comprising (c) a third conveyor means situated adjacent said discharge end of said gathering channel;

(d) oscillating transfer means for periodically transferring first and second article groups simultaneously from said gathering channel to said third conveyor means; and (e) synchronizing means for coordinating the motions of said transfer means and said second article group shifting means.

5. An apparatus as defined in claim 1, wherein said second article group shifting means comprises (a) two article shifting fingers supported spaced from said gathering channel and being spaced from one another parallel to the direction of article advance and each extending towards said gathering channel generally perpendicularly to the direction of article advance;

(b) first means for periodically moving said fingers as a unit codirectionally towards and away from said gathering channel to project into and, respectively, to be clear of a travelling path of the articles on said gathering channel;

(c) second means for moving said fingers as a unit back and forth parallel to said direction of article advance to execute alternating forward strokes and return strokes; and (d) synchronizing means for coordinating said first and second means with one another for moving said fingers towards said gathering channel at the beginning of each forward stroke and for moving said fingers away from said gathering channel at the beginning of each return stroke; said synchronizing means including means for coordinating the motion of said fingers towards said gathering channel with the motions of said second conveyor means and said first article group shifting means.

6. In a method of operating an apparatus for forming article groups each consisting of a plurality of edgewise upright oriented, generally flat stacked articles, including the step of advancing the articles in a lying orientation by a first conveyor and transferring them individually onto a second conveyor; advancing and turning the articles by said second conveyor and depositing the articles by the second conveyor individually on a gathering channel in an edgewise upright orientation; the improvement comprising the following steps:

(a) periodically forming, by a first article group shfiting means, a first group of articles of predetermined number from artices accumulating on said gathering channel as deposited by said second conveyor and individually advancing said first group on said gathering channel by said first article group shifting means;

(b) moving, as part of the periodic group forming and advancing steps, said first article group shifting means along said gathering channel with a first speed;

(c) subsequent to step (a), periodically forming, by a second article group shifting means, a second group of articles of predetermined number from articles accumulating on said gathering channel as deposited by said second conveyor after the first group is moved away by said first article group shifting means;

(d) simultaneously advancing said first and second groups by said second article group shifting means to a discharge end of said gathering channel; and (e) moving, as part of the periodic, simultaneous advancing step, said second article group shifting means along said gathering channel with a second speed which is greater than said first speed.

* * * * *